US006815403B1

(12) United States Patent
Laney

(10) Patent No.: US 6,815,403 B1
(45) Date of Patent: Nov. 9, 2004

(54) TOILET DRAIN CLEANING COMPOSITION

(76) Inventor: Kenneth T. Laney, 10673 N. Shupe Rd., Monrovia, IN (US) 46157

( * ) Notice: Subject to any disclaimer, the term of this patent is extended or adjusted under 35 U.S.C. 154(b) by 185 days.

(21) Appl. No.: 10/197,751

(22) Filed: Jul. 18, 2002

(51) Int. Cl.[7] ..... C11D 7/08; C11D 7/18; C11D 1/83; C11D 3/48; C11D 3/50

(52) U.S. Cl. ..... 510/191; 510/192; 510/195; 510/101; 510/367; 510/379; 510/440; 510/447; 510/450; 510/378; 510/467; 510/510; 510/512

(58) Field of Search ..... 510/192, 195, 510/191, 101, 367, 379, 440, 447, 450, 378, 467, 510, 512

(56) References Cited

U.S. PATENT DOCUMENTS 3,597,772 A * 8/1971 Leavitt et al. ..... 4/222
3,766,576 A * 10/1973 Ancel ..... 4/231
4,006,056 A * 2/1977 Weber ..... 435/188
4,269,723 A * 5/1981 Barford et al. ..... 510/192
4,460,490 A * 7/1984 Barford et al. ..... 510/192
4,560,766 A * 12/1985 Girard et al. ..... 548/320.5
4,738,728 A * 4/1988 Barford et al. ..... 134/34
4,911,859 A * 3/1990 Bunczk et al. ..... 510/100
5,336,427 A * 8/1994 Bunczk et al. ..... 510/192
5,833,970 A * 11/1998 Cox ..... 424/76.1

* cited by examiner

*Primary Examiner*—Charles Boyer

(57) ABSTRACT

A new and improved toilet drain composition and method of using is disclosed for use in disinfecting and decalcifying. The toilet drain composition comprises a phosphoric acid derivative admixed with paradichlorobenzene and a diluent. The phosphoric acid derivative may be at a concentration ranging from 0.0000001 to 25% by weight. The paradichlorobenzene 14 may be at a concentration ranging form 0.0000001 to 25% by weight. The diluent may be at a concentration ranging from 0 to 90% by weight. Optional elements such as, an anionic surfactant, non-ionic surfactant, a dinintegration rate regulator, a complexing agent, a peroxy compound, a filler, a fragment essential oil, a dye, a bleaching agent, and a binder may be added to the toilet drain composition. The phase of the composition may be liquid, solid or semi-solid. One preferred configuration of the semi-solid block shape is that it has a series of nested concentric ridges defining a bull's eye target. The method of using the toilet drain composition comprises the steps of obtaining, placing, aiming, hitting, eroding and removing.

2 Claims, 2 Drawing Sheets

TOILET DRAIN CLEANING COMPOSITION

FIELD OF THE INVENTION

The present invention relates to sanitation compositions, more particular, to a toilet drain composition for use in connection with minimizing calcium buildup and maintaining a sanitary environment.

DESCRIPTION OF THE PRIOR ART

A wide variety of toilet drain compositions is currently available on the commercial market and an even larger number of these types of devices are known in the art of toilet drain compositions, for example, the toilet bowl dispenser disclosed by Vlahakis in U.S. Pat. No. 4,096,593; the controlled release composition disclosed by Isoldi in U.S. Pat. No. 4,252,785; the aqueous deodorants and deodorizing methods disclosed by Kobayashi and Kawazoe in U.S. Pat. No. 4,909,986; the improved urinal block composition disclosed by Vlahakis, Manolis, Marrese in U.S. Pat. No. 5,336,424; the urinal block dispenser assembly and composition disclosed by Vlahakis, Manolas and Marrese in U.S. Pat. No. 5,489,415; and the disinfectant dispenser with manual valve disclosed by Akwei in U.S. Pat. No. D400, 965.

While all of the above-described devices fulfill their respective, particular objectives and requirements, the aforementioned patents do not describe a toilet drain composition having a phosphoric acid derivative admixed with a parachlorobenzene component. This component would specifically match the user's particular individual needs makes it possible to provide a powerful disinfectant to the toilet drain composition as well as a composition which can minimize calcium buildup. The above-described patents make no provision for a toilet drain composition having a phosphoric acid derivative admixed with parachlorobenzene.

Therefore, a need exists for a new and improved toilet drain composition having a phosphoric acid derivative admixed with parachlorobenzene as an necessary component that can be used for maintaining a sanitary condition while minimizing calcium buildup. In this respect, the toilet drain composition according to the present invention substantially departs from the conventional concepts and designs of the prior art, and in doing so provides an apparatus primarily developed for the purpose of providing a strong disinfectant coupled which minimizes the buildup of calcium.

SUMMARY OF THE INVENTION

The present device, according to the principles of the present invention, overcomes the shortcomings of the prior art by providing a new and improved toilet drain composition and method of using is disclosed for use in disinfecting and decalcifying. The toilet drain composition comprises a phosphoric acid derivative admixed with paradichlorobenzene and a diluent. The phosphoric acid derivative may be at a concentration ranging from 0.0000001 to 25% by weight. The paradichlorobenzene 14 may be at a concentration ranging form 0.0000001 to 25% by weight. The diluent may be at a concentration ranging from 0 to 90% by weight.

In view of the foregoing disadvantages inherent in the known types of toilet drain compositions now present in the prior art, the present invention provides an improved toilet drain composition, which will be described subsequently in great detail, is to provide a new and improved toilet drain composition which is not anticipated, rendered obvious, suggested, or even implied by the prior art, either alone or in any combination thereof To attain this, the present invention essentially comprises a phosphoric acid derivative admixed with paradichlorobenzene and a diluent. The phosphoric acid derivative may be at a concentration ranging from 0.0000001 to 25% by weight. The paradichlorobenzene 14 may be at a concentration ranging form 0.0000001 to 25% by weight. The diluent may be at a concentration ranging from 0 to 90% by weight.

There has thus been outlined, rather broadly, the more important features of the invention in order that the detailed description thereof that follows may be better understood, and in order that the present contribution of the art may be better appreciated.

The invention may also include additional optional elements, such as, an anionic surfactant, non-ionic surfactant, a dinintegration rate regulator, a complexing agent, a peroxy compound, a filler, a fragment essential oil, a dye, a bleaching agent, and a binder. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein arc for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet drain composition that has all the advantages of the prior art toilet drain composition and none of the disadvantages.

It is another object of the present invention to provide a new and improved toilet drain composition that may be easily and efficiently manufactured and marketed.

An even further object of the present invention is to provide a new and improved toilet drain composition that has a low cost of manufacture with regard to both materials and labor, and which accordingly is then susceptible of low prices of sale to the consuming public, thereby making such multipurpose storage unit and system economically available to the buying public.

Still another object of the present invention is to provide a new toilet drain composition that provides in the apparatuses and methods of the prior art some of the advantages thereof, while simultaneously overcoming some of the disadvantages normally associated therewith.

Even still another object of the present invention is to provide a toilet drain composition having a phosphoric acid derivative admixed with a parachlorobenzene component. This makes it possible to provide a powerful disinfectant to the toilet drain composition as well as a composition which can minimize calcium buildup.

Lastly, it is an object of the present invention to provide a new and improved method of using the toilet drain composition comprises the steps of obtaining, placing, aiming, hitting, eroding, removing.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to he limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
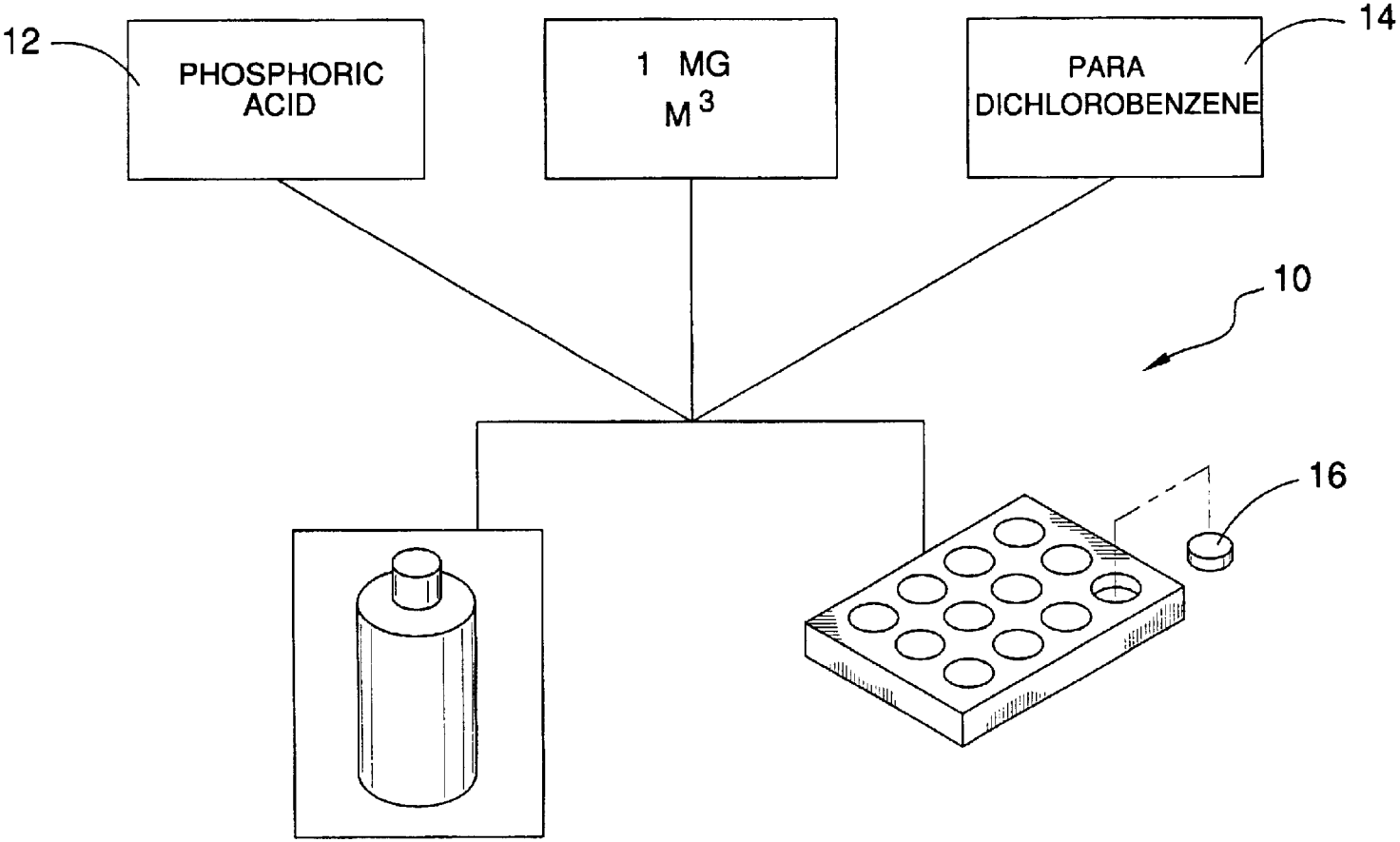
FIG. 1 is a schematic depiction of the mixture of ingredients of a preferred embodiment of the toilet drain composition constructed in accordance with the principles of the present invention.
Figure 2:
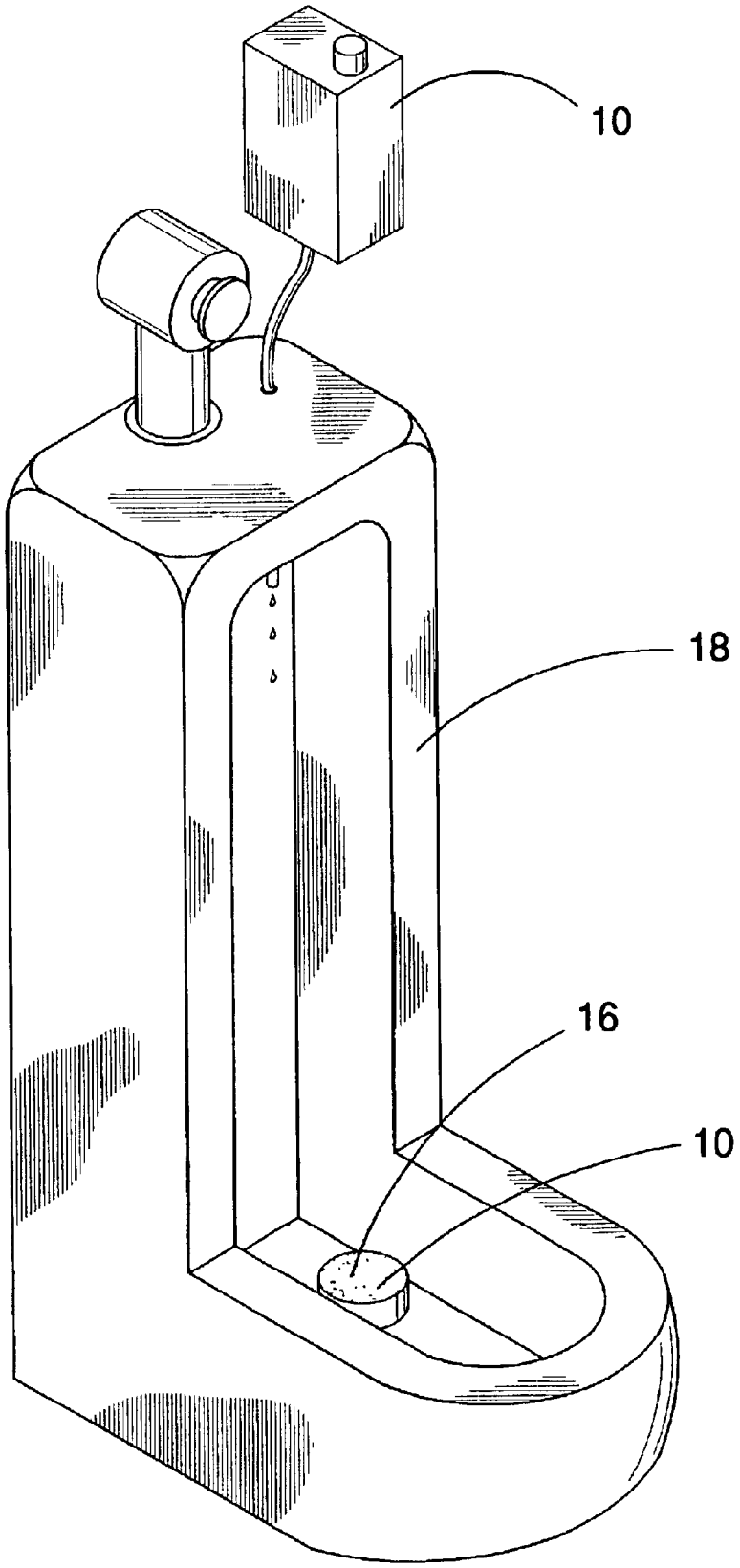
FIG. 2 is a perspective of a preferred embodiment of the toilet drain composition of the present invention.

Referring now to the drawings, and in particular FIG. 1 to 2 thereof, one preferred embodiment of the present invention is shown and generally designated by the reference numeral 10. One preferred embodiment of the present invention of the toilet drain composition 10 comprises a phosphoric acid derivative 12, paradichlorobenzene 14 and a diluent. The phosphoric acid derivative 12 is at a concentration ranging from 0.0000001 to 25% by weight. The paradichlorobenzene 14 is at a concentration ranging form 0.0000001 to 25% by weight. The diluent is at a concentration ranging from 0 to 90% by weight.

Another preferred embodiment of the toilet drain composition 10 comprises a phosphoric acid derivative 12, paradichlorobenzene 14, a diluent, an anionic surfactant, a nonionic surfactant, a disintegration rate regulator, a complexing agent, a peroxy compound, a filler, a fragrant essential oil, a dye, a bleaching agent, and a binder. The phosphoric acid derivative 12 is at a concentration ranging from 0.0000001 to 25% by weight, wherein the phosphoric acid derivative 12 is selected from the group consisting of phosphoric acid, sodium dihydrogen phosphate, disodium hydrogen phosphate, trisodium phosphate, potassium dihydrogen phosphate, dipotassium hydrogen phosphate, and tripotassium phosphate. The paradichlorobenzene 14 is at a concentration ranging form 0.0000001 to 25% by weight. The diluent is at a concentration ranging from 0 to 90% by weight, wherein the diluent is selected from the group consisting of water and coparafinate. The anionic surfactant is selected from the group consisting of alkali metal salts of alkyl substituted benzene sulphonic acids, alkali metal salts of long chain fatty sulphates, alkali metal ether sulphates derived from alcohols and alkyl phenols, alkali metal sulphosuccinates, alkali metal sarcosinates and alkali metal taurides. The nonionic surfactant is selected from the group consisting of alkylene oxide condensates of fatty acids, fatty alcohols or alkyl substituted phenols; ethylene oxide/propylene oxide block copolymers; fatty acid mono- and di-alkanolamides and ethoxylates thereof, and sucrose surfactants. The disintegration rate regulator is selected from the group consisting of fatty acid ethanolamides, fatty acid diethanolamides and stearic acid. The complexing agent is selected from the group consisting of ethylenediamine tetraacetic acid, nitrilotriacetic acid, polycarboxylic acid, and mixtures thereof. The peroxy compound is selected from the group consisting of sodium perborate mono- and tetrahydrate, potassium peroxodisulfate, and sodium peroxodisulfate. The filler comprises sodium sulphate. The fragrant essential oil is at a concentration range from about 0.1 to 10% by weight, wherein the fragrant essential oil is selected from the group consisting of anise, cedar leaf, cedar wood, cherry laurel, cinnamon, citronella, clove, copaiba, cubeb, cypress, dill, dwarf pine needles, eucalyptus, fennel, fleabane, garlic, geranium, ginger, hops, juniper, lavender, lemon, lemon grass, linaloe, myrtle, nutmeg, orange, orange flowers, origanum, patchouli, pennyroyal, peppermint, pettigrain, pine needles, rose, rosemary, santal, sassafras, spearmint, sweet almond, and thyme. The dye is a concentration ranging from about 0.01 to 2% by weight. The dye is selected from the group consisting of FD&C Blue No. 1, FD&C Blue No. 2, FD&C Green No. 1, FD&C Green No. 2, FD&C Green No. 3, FD&C Red No. 1, FD&C Red No. 2, FD&C Red No. 3, FD&C Red No. 4, FD&C Red No. 40, FD&C Yellow No. 1, FD&C Yellow No. 3, FD&C Yellow No. 4, FD&C Yellow No. 5, FD&C Yellow No. 6, and D&C Red No. 19. The bleaching agent is at a concentration range from about 1 to 25% by weight. The bleaching agent is a halogenated hydantoin selected from the group consisting of bromochlorodimethylhydantoin, 1,3-dichloro-5,5-dimethylhydantoin and 1,3-dichloro-5,5-methylethylhydantoin. The binder is selected from the group consisting of ethylene-bis-stearamide, a cellulose ether, an alginate and a caragheenate. The phase of the composition is shaped in a semi-solid block 16 having a series of nested concentric ridges defining a bull's eye target.

One preferred embodiment of the method of using a toilet drain composition 10 for use in placement in a urinal 18, the method comprising the steps of obtaining, placing, aiming, hitting, eroding, removing. The obtaining step comprises obtaining the toilet drain composition 10 including: a phosphoric acid derivative 12 at a concentration ranging from 0.0000001 to 25% by weight, wherein the phosphoric acid derivative 12 is selected from the group consisting of phosphoric acid, sodium dihydrogen phosphate, disodium hydrogen phosphate, trisodium phosphate, potassium dihydrogen phosphate, dipotassium hydrogen phosphate, and tripotassium phosphate; paradichlorobenzene 14 at a concentration ranging form 0.0000001 to 25% by weight; a diluent at a concentration ranging from 0 to 90% by weight, wherein the diluent is selected from the group consisting of water and coparafinate; an anionic surfactant selected from the group consisting of alkali metal salts of alkyl substituted benzene sulphonic acids, alkali metal salts of long chain fatty sulphates, alkali metal ether sulphates derived from alcohols and alkyl phenols, alkali metal sulphosuccinates, alkali metal sarcosinates and alkali metal taurides; a nonionic surfactant selected from the group consisting of alkylene oxide condensates of fatty acids, fatty alcohols or alkyl substituted phenols; ethylene oxide/propylene oxide block copolymers; fatty acid mono- and di- alkanolamides and ethoxylates thereof, and sucrose surfactants; a disintegration rate regulator selected from the group consisting of fatty acid ethanolamides, fatty acid diethanolamides and stearic acid; a complexing agent selected from the group consisting of ethylenediamine tetraacetic acid, nitrilotriacetic acid, polycarboxylic acid, and mixtures thereof; a peroxy compound selected from the group consisting of sodium perborate mono- and tetra-hydrate, potassium peroxodisulfate, and sodium peroxodisulfate; a filler comprising sodium sulphate; a fragrant essential oil at a concentration range from about 0.1 to 10% by weight, wherein the fragrant essential oil selected from the group consisting of anise, cedar leaf, cedar wood, cherry laurel, cinnamon, citronella, clove, copaiba, cubeb, cypress, dill, dwarf pine needles, eucalyptus, fennel, fleabane, garlic, geranium, ginger, hops, juniper, lavender, lemon, lemon grass, linaloe, myrtle, nutmeg, orange, orange flowers, origanum, patchouli, pennyroyal, peppermint, pettigrain, pine needles, rose, rosemary, santal, sassafras, spearmint, sweet almond, and thyme; a dye from about 0.01 to 2% by weight, wherein the dye selected from the group consisting of FD&C Blue No. 1, FD&C Blue No. 2, FD&C Green No. 1, FD&C Green No. 2, FD&C Green No. 3, FD&C Red No. 1, FD&C Red No. 2, FD&C Red No. 3, FD&C Red No. 4, FD&C Red No. 40, FD&C Yellow No. 1, FD&C Yellow No. 3, FD&C Yellow No. 4, FD&C Yellow No. 5, FD&C Yellow No. 6, and D&C Red No. 19; a bleaching agent at a concentration range from about 1 to 25% by weight, wherein the bleaching agent is a halogenated hydantoin selected from the group consisting of bromochlorodimethylhydantoin, 1,3-dichloro-5,5-dimethylhydantoin and 1,3-dichloro-5,5-methylethylhydantoin; and a binder selected from the group consisting of ethylene-bis-stearamide, a cellulose ether, an alginate and a caragheenate, wherein the composition is shaped in a semi-solid block 16 having a series of nested concentric ridges defining a bull's eye target. The placing step comprises placing the semi-solid block 16 at the bottom of a urinal 18. The aiming step comprises aiming a urine stream onto the semi-solid block 16 placed at the bottom of the urinal 18. The hitting step comprises hitting the bull's eye target on the semi-solid block 16 placed at the bottom of the urinal 18 with the urine stream. The eroding step comprises eroding the bull's eye target on the semi-solid block 16 placed at the bottom of the urinal 18 with the urine stream. The removing step comprises removing the semi-solid block 16 placed at the bottom of the urinal 18 when the bull's eye target on the semi-solid block 16 is eroded.

The phase of the toilet drain composition 10 may be a liquid, a solid or a semi-solid material. One preferred configuration of the shape of the composition is that it is shaped in a semi-solid block 16. Furthermore, one preferred configuration is that the composition is shaped in a semi-solid block 16 having a series of nested concentric ridges defining a bull's eye target.

The phosphoric acid derivative 12 is selected from the group consisting of phosphoric acid, sodium dihydrogen phosphate, disodium hydrogen phosphate, trisodium phosphate, potassium dihydrogen phosphate, dipotassium hydrogen phosphate, and tripotassium phosphate.

The diluent is selected from the group consisting of water and coparafinate.

An optional anionic surfactant may be added to the toilet drain composition 10. The anionic surfactant is selected from the group consisting of alkali metal salts of alkyl substituted benzene sulphonic acids, alkali metal salts of long chain fatty sulphates, alkali metal ether sulphates derived from alcohols and alkyl phenols, alkali metal sulphosuccinates, alkali metal sarcosinates and alkali metal taurides.

An optional nonionic surfactant may be added to the toilet drain composition 10. The nonionic surfactant is selected from the group consisting of alkylene oxide condensates of fatty acids, fatty alcohols or alkyl substituted phenols; ethylene oxide/propylene oxide block copolymers; fatty acid mono- and di- alkanolamides and ethoxylates thereof, and sucrose surfactants.

An optional disintegration rate regulator may be added to the toilet drain composition 10. The disintegration rate regulator is selected from the group consisting of fatty acid ethanolamides, fatty acid diethanolamides and stearic acid.

An optional complexing agent may be added to the toilet drain composition 10. The complexing agent is selected from the group consisting of ethylenediamine tetraacetic acid, nitrilotriacetic acid, polycarboxylic acid, and mixtures thereof.

An optional peroxy compound may be added to the toilet drain composition 10. The peroxy compound is selected from the group consisting of sodium perborate mono- and tetra-hydrate, potassium peroxodisulfate, and sodium peroxodisulfate.

An optional filler may be added to the toilet drain composition 10. The filler is sodium sulphate.

An optional fragrant essential oil may be added to the toilet drain composition 10. The fragrant essential oil is at a concentration range from about 0.1 to 10% by weight. The fragrant essential oil is selected from the group consisting of anise, cedar leaf, cedar wood, cherry laurel, cinnamon, citronella, clove, copaiba, cubeb, cypress, dill, dwarf pine needles, eucalyptus, fennel, fleabane, garlic, geranium, ginger, hops, juniper, lavender, lemon, lemon grass, linaloe, myrtle, nutmeg, orange, orange flowers, origanum, patchouli, pennyroyal, peppermint, pettigrain, pine needles, rose, rosemary, santal, sassafras, spearmint, sweet almond, and thyme.

An optional dye may be added to the toilet drain composition 10. The dye is at a concentration of about 0.01 to 2% by weight. The dye is selected from the group consisting of FD&C Blue No. 1, FD&C Blue No. 2, FD&C Green No. 1, FD&C Green No. 2, FD&C Green No. 3, FD&C Red No. 1, FD&C Red No. 2, FD&C Red No. 3, FD&C Red No. 4, FD&C Red No. 40, FD&C Yellow No. 1, FD&C Yellow No. 3, FD&C Yellow No. 4, FD&C Yellow No. 5, FD&C Yellow No. 6, and D&C Red No. 19.

An optional bleaching agent may be added to the toilet drain composition 10. The bleaching agent is at a concentration range from about 1 to 25% by weight, wherein the bleaching agent is a halogenated hydantoin selected from the group consisting of bromochlorodimethylhydantoin, 1,3-dichloro-5,5-dimethylhydantoin and 1,3-dichloro-5,5-methylethylhydantoin.

An optional binder may be added to the toilet drain composition 10. One preferred configuration of the binder is that it comprises ethylene-bis-stearamide. Another preferred configuration of the binder is that the binder is a cellulose ether, an alginate or a caragheenate, wherein the cellulose ester is selected from the group consisting of methyl cellulose, ethyl cellulose, sodium carboxymethyl cellulose, hydroxypropyl cellulose, hydroxypropyl methyl cellulose, ethyl hydroxyethyl cellulose, carboxymethyl hydroxyethyl cellulose and hydroxyethyl cellulose. Yet another preferred configuration of the binder is that it comprises a synthetic polymer selected from the group consisting of a polyvinyl alcohol, water-soluble partially hydrolysed polyvinyl acetate, polyacrylonitrile, polyvinyl pyrolidones, water-soluble polymer of an ethylenically unsaturated carboxylic acid, or salt thereof, base-hydrolysed starch-polyacrylonitrile copolymer, ethylene oxide polymer and a carboxypolymethylene.

As to the manner of usage and operation of the present invention, the same should be apparent from the above description. Accordingly, no further discussion relating to the manner of usage and operation will be provided.

While a preferred embodiment of the toilet drain composition has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet drain cleaning composition comprising:

a phosphoric acid derivative at a concentration ranging from 0.0000001 to 25% by weight, wherein said phosphoric acid derivative is selected from the group consisting of phosphoric acid, sodium dihydrogen phosphate, disodium hydrogen phosphate, trisodium phosphate, potassium dihydrogen phosphate, dipotassium hydrogen phosphate, and tripotassium phosphate;

paradichlorobenzene at a concentration ranging form 0.0000001 to 25% by weight;

a diluent at a concentration ranging from 0 to 90% by weight;

an anionic surfactant selected from the group consisting of alkali metal salts of alkyl substituted benzene sulphonic acids, alkali metal salts of long chain fatty sulphates, alkali metal ether sulphates derived from alcohols and alkyl phenols, alkali metal sulphosuccinates, alkali metal sarcosinates and alkali metal taurides;

a nonionic surfactant selected from the group consisting of alkylene oxide condensates of fatty acids, fatty alcohols or alkyl substituted phenols; ethylene oxide/propylene oxide block copolymers; fatty acid mono- and di-alkanolamides and ethoxylates thereof, and sucrose surfactants;

a disintegration rate regulator selected from the group consisting of fatty acid ethanolamides, fatty acid diethanolamides and stearic acid;

a complexing agent selected from the group consisting of ethylenediamine tetraacetic acid, nitrilotriacetic acid, polycarboxylic acid, and mixtures thereof;

a peroxy compound selected from the group consisting of sodium perborate mono- and tetra-hydrate, potassium peroxodisulfate, and sodium peroxodisulfate;

a filler comprising sodium sulphate;

a fragrant essential oil at a concentration range from about 0.1 to 10% by weight, wherein said fragrant essential oil selected from the group consisting of anise, cedar leaf, cedar wood, cherry laurel, cinnamon, citronella, clove, copaiba, cubeb, cypress, dill, dwarf pine needles, eucalyptus, fennel, fleabane, garlic, geranium, ginger, hops, juniper, lavender, lemon, lemon grass, linaloe, myrtle, nutmeg, orange, orange flowers, origanum, patchouli, pennyroyal, peppermint, pettigrain, pine needles, rose, rosemary, santal, sassafras, spearmint, sweet almond, and thyme;

a dye from about 0.01 to 2% by weight, wherein said dye selected from the group consisting of FD&C Blue No. 1, FD&C Blue No. 2, FD&C Green No. 1, FD&C Green No. 2, FD&C Green No. 3, FD&C Red No. 1, FD&C Red No. 2, FD&C Red No. 3, FD&C Red No. 4, FD&C Red No. 40, FD&C Yellow No. 1, FD&C Yellow No. 3, FD&C Yellow No. 4, FD&C Yellow No. 5, FD&C Yellow No. 6, and D&C Red No. 19;

a bleaching agent at a concentration range from about 1 to 25% by weight, wherein the bleaching agent is a halogenated hydantoin selected from the group consisting of bromochlorodimethylhydantoin, 1,3-dichloro-5,5-dimethylhydantoin and 1,3-dichloro-5,5-methylethylhydantoin; and a binder selected from the group consisting of ethylene-bis-stearamide, a cellulose ether, an alginate and a caragheenate; wherein said composition is shaped in a semi-solid block having a series of nested concentric ridges defining a bulls eye target.

2. A method of using a toilet drain cleaning composition for use in placement in a urinal, said method comprising the steps of:

obtaining the toilet drain cleaning composition including:

a phosphoric acid derivative at a concentration ranging from 0.0000001 to 25% by weight, wherein said phosphoric acid derivative is selected from the group consisting of phosphoric acid, sodium dihydrogen phosphate, disodium hydrogen phosphate, trisodium phosphate, potassium dihydrogen phosphate, dipotassium hydrogen phosphate, and tripotassium phosphate;

paradichlorobenzene at a concentration ranging form 0.0000001 to 25% by weight;

a diluent at a concentration ranging from 0 to 90% by weight;

an anionic surfactant selected from the group consisting of alkali metal salts of alkyl substituted benzene sulphonic acids, alkali metal salts of long chain fatty sulphates, alkali metal ether sulphates derived from alcohols and alkyl phenols, alkali metal sulphosuccinates; alkali metal sarcosinates and alkali metal taurides;

a nonionic surfactant selected from the group consisting of alkylene oxide condensates of fatty acids, fatty alcohols or alkyl substituted phenols; ethylene oxide/propylene oxide block copolymers; fatty acid mono- and di- alkanolamides and ethoxylates thereof, and sucrose surfactants;

a disintegration rate regulator selected from the group consisting of fatty acid ethanolamides, fatty acid diethanolamides and stearic acid;

a complexing agent selected from the group consisting of ethylenediamine tetraacetic acid, nitrilotriacetic acid, polycarboxylic acid, and mixtures thereof;

a peroxy compound selected from the group consisting of sodium perborate mono- and tetra-hydrate, potassium peroxodisulfate, and sodium peroxodisulfate;

a filler comprising sodium sulphate;

a fragrant essential oil at a concentration range from about 0.1 to 10% by weight, wherein said fragrant essential oil selected from the group consisting of anise, cedar leaf, cedar wood, cherry laurel, cinnamon, citronella, clove, copaiba, cubeb, cypress, dill, dwarf pine needles, eucalyptus, fennel, fleabane, garlic, geranium, ginger, hops, juniper, lavender, lemon, lemon grass, linaloe, myrtle, nutmeg, orange, orange flowers, origanum, patchouli, pennyroyal, peppermint, pettigrain, pine needles, rose, rosemary, santal, sassafras, spearmint, sweet almond, and thyme;

a dye from about 0.01 to 2% by weight, wherein said dye selected from the group consisting of FD&C Blue No. 1, FD&C Blue No. 2, FD&C Green No. 1, FD&C Green No. 2, FD&C Green No. 3, FD&C Red No. 1, FD&C Red No. 2, FD&C Red No. 3, FD&C Red No. 4, FD&C Red No. 40, FD&C Yellow No. 1, FD&C Yellow No. 3, FD&C Yellow No. 4, FD&C Yellow No. 5, FD&C Yellow No. 6, and D&C Red No. 19;

a bleaching agent at a concentration range from about 1 to 25% by weight, wherein the bleaching agent is a halogenated hydantoin selected from the group consisting of bromochlorodimethylhydantoin, 1,3-dichloro-5,5-dimethylhydantoin and 1,3-dichloro-5,5-methylethylhydantoin; and a binder selected from the group consisting of ethylene-bis-stearamide, a cellulose ether, an alginate and a caragheenate; wherein said composition is shaped in a semi-solid block having a series of nested concentric ridges defining a bulls eye target;

placing the semi-solid block at the bottom of a urinal;

aiming a urine stream onto the semi-solid block placed at the bottom of the urinal;

hitting the bulls eye target on the semi-solid block placed at the bottom of the urinal with the urine stream;

eroding the bulls eye target on the semi-solid block placed at the bottom of the urinal with the urine stream; and removing the semi-solid block placed at the bottom of the urinal when the bulls eye target on the semi-solid block is eroded.

* * * * *